United States Patent [19]

Rodgers

[11] 4,191,411

[45] Mar. 4, 1980

[54] CHILD SAFE LATCH

[76] Inventor: Milas M. Rodgers, 3139 Medina, Irving, Tex. 75061

[21] Appl. No.: 926,003

[22] Filed: Jul. 19, 1978

[51] Int. Cl.[2] ..... E05C 19/06

[52] U.S. Cl. ..... 292/87; 292/128

[58] Field of Search ..... 292/19, 20, 88, 87, 292/89, 61, 128; 312/333, 348

[56] References Cited

U.S. PATENT DOCUMENTS

| | | | |
|---|---|---|---|
| 538,305 | 4/1895 | Wait | 312/333 UX |
| 1,172,711 | 2/1916 | Hunter | 312/333 UX |
| 1,516,692 | 11/1924 | Andreas | 292/89 |
| 1,948,908 | 2/1934 | Evans | 292/128 UX |
| 2,079,648 | 5/1937 | Aldeen et al. | 312/333 UX |
| 3,381,992 | 5/1968 | Friesen | 292/87 |
| 3,397,001 | 8/1968 | Friedman | 292/87 |
| 3,556,572 | 1/1971 | Olsson | 292/128 X |
| 3,658,394 | 4/1972 | Gutner | 312/348 X |
| 3,879,072 | 4/1975 | Tuley | 292/87 X |

FOREIGN PATENT DOCUMENTS

| | | | |
|---|---|---|---|
| 253967 | 5/1967 | Austria | 292/87 |
| 2232619 | 1/1973 | Fed. Rep. of Germany | 292/19 |
| 82221 | 8/1953 | Norway | 292/128 |

*Primary Examiner*—J. Franklin Foss

*Attorney, Agent, or Firm*—Hubbard, Thurman, Turner, Tucker & Glaser

[57] ABSTRACT

A safety latch assembly for securing the door of a cabinet is disclosed. The latch assembly includes a strike plate attached to the cabinet near an access opening, and a resilient striker mounted on the door of the cabinet. The strike plate includes a flat base mounting portion from which an abutment or lip portion projects. The striker includes a flat base mounting portion from which an elongated resilient leaf portion projects. The resilient leaf portion is characterized by a spring constant which permits the leaf, when forced into engagement with the abutment, to deflect and rotate into a latched position thereon in response to a first applied force which is less than a predetermined threshold level, and which permits the leaf to deflect and pass over the abutment in response to an applied force which is equal to or greater than the predetermined threshold level. The position of the striker is adjustable relative to the strike plate to permit the threshold force level to be set to a value sufficiently large to ensure that a child will be physically unable to open the latch, and sufficiently low enough to ensure that an adult can open the latch with relative ease.

5 Claims, 5 Drawing Figures

FIG. 1
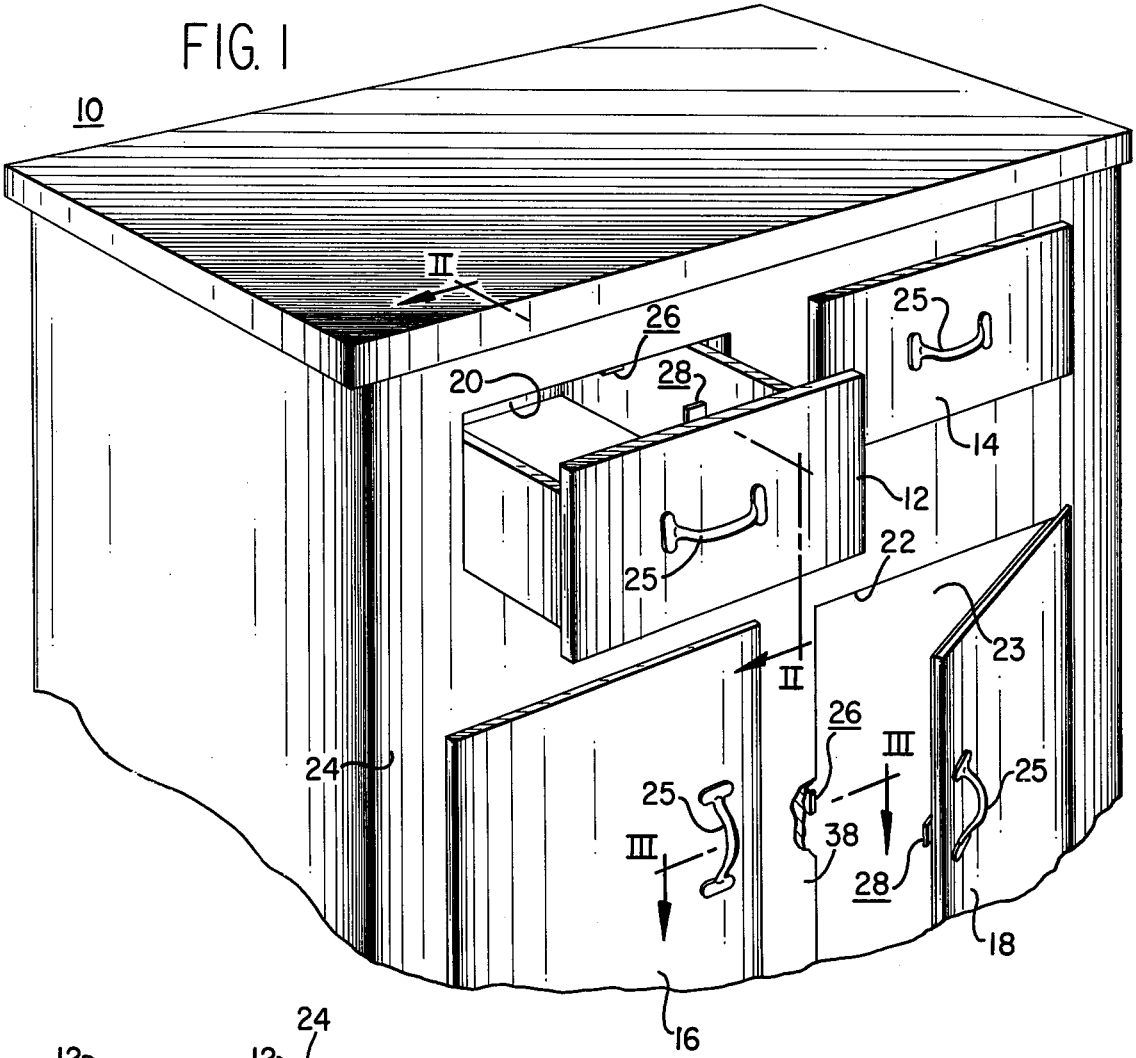
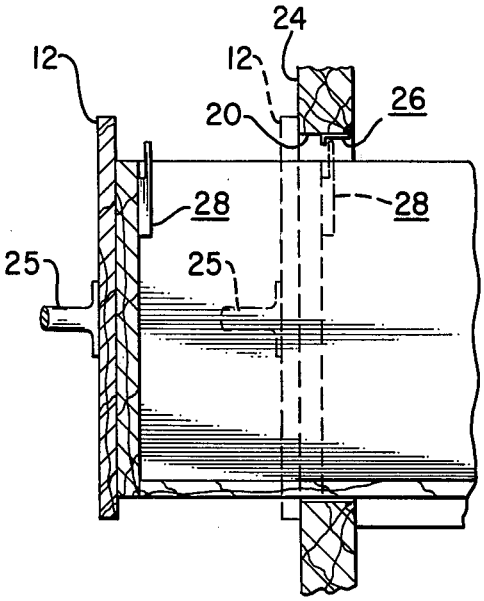
FIG. 2

CHILD SAFE LATCH

BACKGROUND OF THE INVENTION

1. Field of the Invention

The present invention relates generally to fastening devices, and in particular the invention is related to a safety latch for securing a drawer or a door of a cabinet.

2. Description of the Prior Art

Dangerous or poisonous materials such as medicines and cleaning agents are commonly stored in drawers and cabinets which are within convenient reach of children as well as adults. Various safety latches have been proposed for safeguarding the drawers and cabinet doors to prevent entry or access by children. The following patents are representative of prior art approaches to solving this problem: U.S. Pat. No. 3,381,992 to Friesen; U.S. Pat. No. 3,397,001 to Friedman; U.S. Pat. No. 3,879,072 to Tuley; and, U.S. Pat. No. 3,889,992 to Shelton. In the approach suggested by Friesen, a fastener is provided which includes a resilient latch member having a plurality of detent notches and a pin which cooperate to prevent more than partial opening of the drawer or door and must be manipulated to obtain complete release. A similar arrangement is disclosed by Friedman in which the latch and pin are serrated to provide positive latching action. A slightly different structure which requires additional manipulation is disclosed by Tuley in which a guide member having wide and narrow slots is engaged by a pin having a corresponding narrow diameter and wide diameter. In this arrangement, the wide diameter portion of the pin travels along the wide portion of the slot until the narrow slotted portion is reached. At that point the guide must be depressed to permit the narrow diameter portion of the pin to travel along the corresponding narrow slotted portion of the guide. Yet another approach is suggested by Shelton in which a curved resilient bifurcated stop cooperates with a resilient arm having a spherical latching lug for engaging the bifurcated stop. In this arrangement additional manipulation is also required to release the latching lug from the bifurcated stop.

A common feature of the prior art approaches described above is that each requires a separate manipulating step during its operation to permit access or entry into a compartment closed by a drawer or door. These approaches are founded upon the assumption that a toddler or child lacks the intelligence or muscular coordination required to perform the release manipulation steps. In view of the wide variation in the natural ability of children and their ability to learn by observing the actions of adults, that assumption would appear to be valid for only a relatively small number of children. Thus there remains considerable interest in providing a latch assembly having a child safety protective feature which operates independently of a child's learning ability or muscular coordination development level.

SUMMARY OF THE INVENTION

Operation of the latch assembly of the present invention is based upon the relative difference in physical strength which exists between an adult and a child. The physical strength of the child is relatively more predictable as a function of his age than is his intelligence, muscular coordination, and learning ability.

The relative difference in the physical strength of a child versus that of an adult is the basis for the operation of the latch assembly of the present invention in which a strike plate is attached to an enclosure such as a kitchen cabinet and a resilient striker is mounted on a closure member such as a cabinet door. The strike plate is disposed within the path followed by the resilient striker as the striker is carried by movement of the closure member. The striker includes a resilient, elongated leaf portion which resists movement of the door from the closed position to the open position and which is deflected in proportion to the force of engagement to permit the door to open only upon the application of a force greater than a predetermined threshold value. The predetermined threshold value corresponds generally to the force required to deflect the striker sufficiently to cause it to disengage the strike plate while moving from the closed position to the open position. Means are provided for adjustably attaching the striker to the door to permit the area of engagement between the resilient leaf portion and the strike plate to be increased or decreased, thereby permitting the adjustment of the threshold force value required to open the door. This threshold force value can be set at a level great enough so that it cannot be overcome by the efforts of a child, but which can be easily overcome by an adult.

The novel features which characterize the invention with respect to its organization and method of operation, together with further objects and advantages, will be better understood from the following description of a preferred embodiment when considered in connection with the accompanying drawing.

BRIEF DESCRIPTION OF THE DRAWING

FIG. 1 is a perspective view of a preferred embodiment of the invention, shown installed on a drawer and on the door of a cabinet;

FIG. 2 is a vertical sectional view of the drawer installation of FIG. 1 taken along the lines II—II;

DETAILED DESCRIPTION OF A PREFERRED EMBODIMENT

Figure 3:
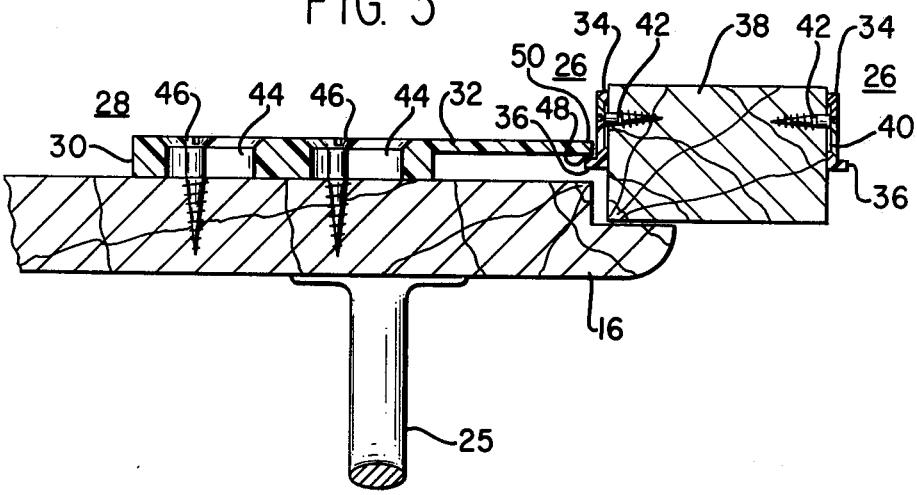
FIG. 3 is sectional view of the door installation of FIG. 1 taken along the lines III—III.

Referring to FIG. 1, there is shown a kitchen cabinet 10 having drawers 12, 14 and doors 16, 18 on which the latch assembly of the invention is installed. The drawer 12 is preferably the type which is mounted on conventional guides (not shown) for supporting the drawer for movement into and out of the cabinet 10 through an access opening 20. The doors 16, 18 are hinged vertically along one side of an access opening 22 to permit relative movement of the door thereby providing a movable barrier for an interior compartment 23. In each case, the access openings 20 and 22 are defined by cutout portions in a front panel member 24 of the cabinet 10, and a pull handle 25 is attached to each drawer and door according to conventional cabinet construction.

Details of the latch installation for the drawer 12 are shown in FIG. 2. The latch assembly comprises generally a strike plate 26 and a striker 28. The strike plate 26 is attached to the cabinet 10 along the upper inside edge of the access opening 20 and the striker 28 is attached to the inside of the drawer 12 in vertical and horizontal alignment with the striker plate 26. The striker 28 is aligned with the strike plate 26 so that it engages the strike plate as indicated by the dashed lines of FIG. 2 which correspond to the closed position of the drawer 12.

Figure 4:
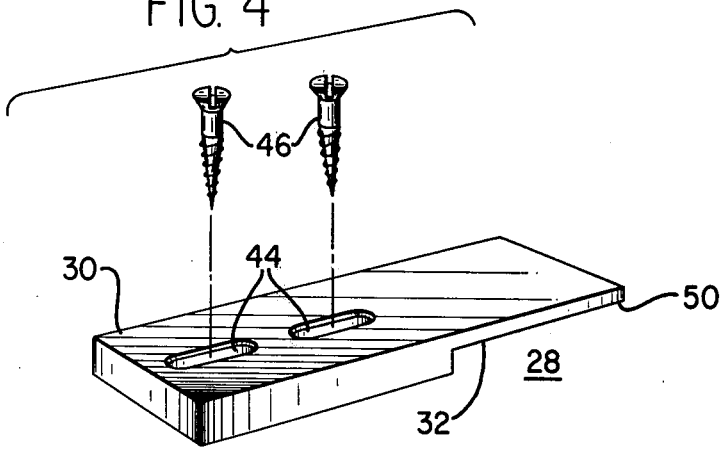
FIG. 4 is a perspective view of the resilient striker of FIG. 3.
Figure 5:
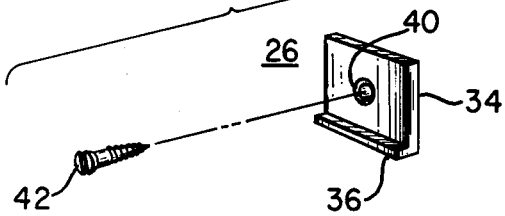
FIG. 5 is a perspective view of the striker plate shown in FIG. 3.

Referring now to FIGS. 4 and 5 of the drawing, the strike plate 26 is preferably constructed from a unitary block of material such as injection molded plastic or polyprophylene. However, other materials such as nylon may be used to good advantage. As shown in FIG. 4, the striker 28 includes a unitary structure having a flat base portion 30 and an elongated resilient leaf portion 32 projecting from the base portion 30. The striker is preferably fabricated from a resilient plastic material such as nylon or polyprophylene. The material selected should provide the resilient leaf portion 32 with a spring constant which permits the leat portion when forced into engagement with the strike plate 26 to deflect and rotate into a latched position in response to an applied force which is less than a predetermined threshold level. According to the invention, the spring constant of the leaf portion 32 is set to deflect and pass over the strike plate 26 is response to an applied force which is equal to or greater than the predetermined threshold level.

The strike plate 26 is a unitary structure which includes a flat base portion 34 and an abutment portion or lip 36 projecting from the base portion. In operation, an end portion of the elongated resilient leaf 32 overlaps and engages the abutment or lip 36 of the strike plate 26 as illustrated in FIGS. 2 and 3 of the drawing.

A horizontal installation is illustrated in FIG. 3 of the drawing in which the strike plate 26 is mounted on a panel partition 38 which separates the lower access opening 22 formed in the front panel member 24. The strike plate 26 is provided with a central opening 40 through which a wood screw 42 or other suitable fastener projects and forms a secure attachment between the strike plate 26 and vertical partition 38. The centrally disposed wood screw 42 allows self-alignment of the strike plate 26 with the plane of the flexible extension of the striker 28, thereby eliminating excessive wear at the contact points.

The base portion 30 of the resilient striker 28 is provided with a pair of elongated openings 44 through which wood screws 46 project and securely fasten the resilient striker to the door 16. The wood screws 46 cooperate with the elongated openings 44 to provide adjustable fastening means for permitting the area of overlap 48 between the end 50 of the elongated resilient leaf portion 32 and the lip 36 to be increased or decreased, thereby permitting adjustment of the threshold force value required to overcome the spring constant of the elongated resilient leaf portion as the door 16 is opened.

The strike plate 26 and striker 28 are aligned relative to each other to permit the lip 36 of the strike plate to contact the resilient leaf portion 32 at a point intermediate the base portion 30 and the end 50 of the leaf 32. According to this arrangement, the contact point between the striker plate lip 36 and the striker leaf 32 is shifted toward the end 50 of the leaf as the leaf deflects in response to forced engagement with the striker plate lip. The contact point between the resilient leaf 32 and lip 36 is shifted towards the edge of the lip 36 as the leaf deflects and rotates in response to forced engagement of the leaf with the lip which occurs as a door is opened or closed. According to the invention, the force level required to cause the resilient leaf 32 to deflect enough to permit it to pass the lip 36 is set at a level great enough to ensure that it cannot be overcome by the efforts of a small child. However, an adult with substantially greater physical strength can overcome the predetermined threshold force level and open the door quite easily in one convenient natural movement. The threshold level can be adjusted from time to time to maintain the threshold level, and it can be increased as desired by a simple mechanical adjustment.

Although a preferred embodiment of the invention has been described in detail, it should be understood that various changes, substitutions, and alterations can be made therein without departing from the spirit and scope of the invention as defined by the appended claims.

What is claimed is:

1. A latch assembly comprising, in combination:

a strike plate;

a striker;

the strike plate including a unitary structure having a flat base portion and an abutment portion projecting from the base portion; and, the striker including a unitary structure having a flat base portion and an elongated resilient leaf spring having an end portion freely projecting from the base portion, the freely projecting end portion having opposite side surfaces disposed for separately engaging the abutment portion as the striker is moved into and out of latching engagement with the strike plate, respectively, the resilient leaf spring being characterized by a yieldable reversing force which permits the tip of the freely projecting end portion when forced into engagement with the abutment to deflect and rotate into a latched position thereon in response to a closing force which is less than a predetermined threshold level, and which permits the free end portion of the leaf to deflect and pass its tip over the abutment in response to an opening force which is equal to or greater than the predetermined threshold level.

2. A latch assembly for use with an enclosure of the type including an interior compartment, an opening formed in the enclosure providing access to the compartment, and a closure member mounted on the enclosure for movement relative to the access opening thereby providing a movable barrier which may be moved to an open position for permitting access to the interior of the compartment, and which can be moved to a closed position for restricting access to the interior of the compartment, the latch assembly comprising:

a strike plate for attachment to the enclosure having a stop portion for projecting into the access opening when the strike plate is attached; and, a striker including a base portion for attachment to the closure member and a resilient member freely projecting from the base portion and having opposite side surfaces disposed for separately engaging the stop portion of the strike plate, the resilient member being characterized by radial deflection which increases in proportion to the increase in the force of engagement of the resilient portion against the stop portion as the closure member is opened or closed.

3. A latch assembly for use with a cabinet of the type including an interior storage compartment, an opening formed in the cabinet providing access to the compartment, and a door pivotally mounted on the cabinet for opening and closing the access opening, the latch assembly comprising:

a strike plate having a base portion for attachment to the cabinet near the access opening and having a lip portion projecting from the base portion into the access opening when the base portion is attached thereto; and, a striker having a base portion for attachment to the door and having a resilient, elongated leaf portion freely projecting from the base portion, the freely projecting leaf portion having opposite side surfaces disposed for separately engaging the lip portion of the strike plate as the door is opened and closed, respectively.

4. In a cabinet of the type including an interior storage compartment, an opening formed in the cabinet providing access to the compartment, and a door movably mounted on the cabinet for opening and closing the access opening, the combination with the cabinet of a latch assembly comprising a strike plate attached to the cabinet and a striker attached to the door, the strike plate having a base portion attached to the cabinet near the access opening and having a lip portion projecting from the base portion into the access opening and within the path of the striker as it is carried by the door, the striker having a base portion attached to the door and a resilient, elongated leaf spring having an end portion freely projecting from the base portion in spaced relation with the door, the freely projecting end portion having opposite side surfaces disposed for separately engaging the lip portion of the strike plate as the striker is moved into and out of latching engagement with the strike plate, respectively, the strike plate and striker being aligned relative to each other to permit the lip of the strike plate to contact the resilient leaf portion on the opposite side surfaces of the freely projecting end portion at a point intermediate the base portion and the tip of the elongated resilient leaf as the door is opened and closed, respectively, whereby the contact point between the strike plate lip portion and striker leaf is shifted toward the tip of the leaf as the leaf deflects in response to forced engagement with the strike plate lip.

5. In combination:

an enclosure including an interior compartment having an access opening;

a closure member mounted for movement relative to the access opening providing a movable barrier which may be moved to an open position for permitting access to the interior of the compartment, and which can be moved to a closed position for restricting access to the interior of the compartment; and, a latch assembly including a strike plate attached to the enclosure and a striker mounted on the closure member, the strike plate being disposed within the path followed by the striker as it is carried by movement of the closure member, the striker including a base portion attached to the closure means, and a resilient, elongated leaf member freely projecting from the base portion in spaced relation with the closure member, the elongated leaf member having opposite side surfaces disposed for separately engaging the strike plate as the striker is moved into and out of latching engagement with the strike plate, respectively, the striker being aligned with the strike plate whereby the striker is engaged by the strike plate at a point on the opposite side surfaces of the resilient leaf member intermediate its projecting end portion and its base portion as the closure member is opened and closed, respectively.

* * * * *

UNITED STATES PATENT AND TRADEMARK OFFICE

CERTIFICATE OF CORRECTION

PATENT NO. : 4,191,411

DATED : March 4, 1980

INVENTOR(S) : Milas M. Rodgers

It is certified that error appears in the above—identified patent and that said Letters Patent is hereby corrected as shown below:

Column 2, line 40, after "is" insert -- a --.

Column 3, line 17, "leat" should read -- leaf --.

Signed and Sealed this

Ninth Day of June 1981

[SEAL]

*Attest:*

RENE D. TEGTMEYER

*Attesting Officer*

*Acting Commissioner of Patents and Trademarks*